US005356483A

United States Patent [19]

Saalmann et al.

[11] Patent Number: 5,356,483

[45] Date of Patent: Oct. 18, 1994

[54] PROCESS FOR THE CONTINUOUS MACHINE-WASHING OF INSTITUTIONAL CROCKERY

[75] Inventors: Güenther Saalmann, Gevelsberg; Josef Selbertinger, Staudach; Thomas Schuster, Duesseldorf; Udo Schaab, Misselberg; Friedel Rings, Monheim, all of Fed. Rep. of Germany

[73] Assignee: Henkel Kommanditgesellschaft auf Aktien, Duesseldorf, Fed. Rep. of Germany

[21] Appl. No.: 859,419

[22] PCT Filed: Nov. 14, 1990

[86] PCT No.: PCT/EP90/01945

§ 371 Date: Jul. 23, 1992

§ 102(e) Date: Jul. 23, 1992

[87] PCT Pub. No.: WO91/07904

PCT Pub. Date: Jun. 13, 1991

[30] Foreign Application Priority Data

Nov. 23, 1989 [DE] Fed. Rep. of Germany ..... 3938755

[51] Int. Cl.[5] ..... B08B 3/02

[52] U.S. Cl. ..... 134/25.2; 134/18; 134/25.5; 134/34; 134/56 D; 134/57 D

[58] Field of Search ..... 134/25.2, 25.3, 25.4, 134/25.5, 26, 32, 34, 18, 10, 56 D, 57 D, 72, 95.1

[56] References Cited

U.S. PATENT DOCUMENTS

| | | | |
|---|---|---|---|
| 2,619,097 | 11/1952 | Bromssen | 134/57 D |
| 3,896,827 | 7/1975 | Robinson | 134/25.2 X |
| 4,076,554 | 2/1978 | Weihe | 134/18 X |
| 4,319,930 | 3/1982 | Yano et al. | 134/25.5 X |
| 4,375,993 | 3/1983 | Stevens et al. | 134/25.4 |
| 4,379,031 | 4/1983 | Krothiewicz et al. | 134/26 |
| 4,561,904 | 12/1985 | Eberhardt, Jr. | 134/18 |

*Primary Examiner*—Richard O. Dean
*Assistant Examiner*—Saeed T. Chaudhry
*Attorney, Agent, or Firm*—Ernest G. Szoke; Wayne C. Jaeschke; Daniel S. Ortiz

[57] ABSTRACT

A method for washing institutional crockery in a dish-washing machine having at least three washing zones with at least three wash tanks in which the crockery is contacted with wash liquor having an increased concentration of surfactant by introducing make-up surfactant into the penultimate wash tank and bypassing a portion of the fresh water feed from the last wash tank around the penultimate wash tank.

16 Claims, 3 Drawing Sheets

PROCESS FOR THE CONTINUOUS MACHINE-WASHING OF INSTITUTIONAL CROCKERY

BACKGROUND OF THE INVENTION

This invention relates to a process for the continuous machine-washing of institutional crockery in an institutional dishwashing machine comprising a wash zone and a following rinse zone, in which the soiled crockery is successively sprayed with wash liquor in at least three wash zones fed from separate tanks by means of circulation pumps and a system of spray nozzles, the wash liquor cascading preferably from the last to the first tank on the overflow principle and the detergent concentration in the wash liquor first being separately established in the individual tanks by predosing and, after the start of the washing process, being maintained by after-dosing of detergent and inflow of fresh water into the last tank, and in which so-called thorough washing is optionally carried out at relatively long time intervals with a distinctly increased concentration of detergent in the wash liquor.

RELATED ART

One such process is known from the prior art and is often applied in institutional dishwashing machines. In this process, the concentration of detergent in the individual washing tanks is normally kept substantially the same except for so-called thorough washing which is normally carried out, for example, once a month with an increased concentration of detergent in the wash liquor. Despite this thorough monthly wash, however, the first signs of so-called accumulated starch deposits on the dishes can be seen after a few days.

Accordingly, it is proposed in DE-OS 37 07 366 to install an additional spraying system for this process and, using this spraying system, to spray highly concentrated detergent mists containing 100 to 1000 g detergent per liter water onto the dishes in a wash zone. Although this process improves overall dishwashing performance, it is still attended by disadvantages. Thus, it is necessary on the one hand to provide an additional spraying system which complicates and adds to the cost of institutional dishwashing machines. On the other hand, on account of its high alkalinity, the detergent solution sprayed in such high concentrations is a major potential hazard to the machine operator, not least because of the staying power of the fine mist. For example, in the event of malfunctions of the machine, the machine operator can come into skin contact with the highly alkaline detergent solution or may even be splashed in the eye with detergent solution with the resulting danger to eyesight. In addition, where highly alkaline detergent solutions are used, special and additional measures have to be taken to protect the dishwashing machines against corrosion.

The object of the present invention was to provide a solution which would enable the dishwashing performance of conventional processes to be increased with no increase in overall detergent consumption and without having to use detergent solutions of extremely high concentration.

SUMMARY OF THE INVENTION

In a process of the type mentioned at the beginning, the solution provided by the invention is characterized in that a main component stream of wash liquor amounting to more than 50% and preferably to more than 75% of the quantity of fresh water flowing into the last tank is branched off from the last tank and is fed directly to the third-to-last tank and/or to a tank situated further to the front, in that the remaining wash liquor passes through the tanks as a secondary component stream, cascading at least from the middle and/or penultimate tank, and in that a detergent concentration increased by at most the factor of the division ratio of fresh water to secondary component stream is adjusted in the wash liquor in at least the middle tank and/or the penultimate tank, the after-dosing of detergent taking place in this tank only.

It is possible by this process to establish a distinctly increased concentration of detergent in the wash liquor—compared with conventional processes—in the wash zone of an institutional dishwashing machine (in the middle tank of a three-tank machine) without at the same time increasing the overall consumption of detergent compared with conventional processes and without having to use the extremely high concentrations of detergent mentioned, for example, in DE-OS 37 07 366. On the contrary, the upper limit to the concentration established lies within the concentration range of typical thorough dishwashing cycles. Despite the increase in concentration in the middle tank, it is possible by the process according to the invention to save detergent by comparison with conventional dishwashing processes. This saving of detergent arises out of the fact that detergent is only after-dosed into the middle tank and need only be introduced in the desired concentration into the secondary component stream in the middle tank. No detergent is after-dosed into the main component stream. Here, detergent is introduced solely by the carryover of detergent or wash liquor by the dishes which transport adhering wash liquor from one tank to the next. Despite the saving of detergent, a distinctly better cleaning effect compared with conventional processes is still obtained by virtue of the increased concentration in one tank. Through the absence of extremely high concentrations, there is no particular danger to the machine operator beyond the norm. Similarly, no particular measures have to be taken to prevent corrosion in the dishwashing machine. In particular, no fine floating spray mists are formed.

To obtain a further improvement in cleaning performance and to enable any accumulated starch deposits still occurring to be selectively removed, the detergent saved over a certain period may be used for thorough washing with an increased concentration of detergent after this period. To this end, it is proposed in accordance with the invention to establish a detergent concentration below the division ratio for a certain time and to add the quantity of detergent saved in the meantime in a wash cycle using a distinctly increased concentration of detergent.

In one particularly advantageous embodiment of the invention, the division ratio is preferably adjusted to values between 1 and 20 and preferably between 3 and 10.

A particularly favorable supply of the fresh water required is obtained if the quantity of fresh water flowing into the last tank comes from the rinse zone.

In order to prevent the last tank before the rinse zone from emptying, another embodiment of the invention is characterized in that, on the response of a level probe, fresh water is fed to the last tank through another fresh water inlet preferably comprising fan jet nozzles.

Since a concentration exceeding the desired concentration may occur through carryover in the last tank before the rinse zone, another embodiment of the invention is characterized in that conductivity is measured in the last tank and, if the set detergent concentration is exceeded, the other fresh water inlet is opened.

To enable the main component stream to be favorably branched and used to control the process as a whole, another advantageous embodiment of the invention is characterized in that the main component stream is branched off from the riser on the pressure side of the circulation pump of the last tank and in that, starting from the last tank, the secondary component stream cascades through the tanks.

In another embodiment of the invention, the secondary component stream is branched off from the riser on the pressure side of the circulation pump of the last tank and is fed to the middle and/or penultimate tank while the main component stream is fed by a bypass from the last tank to the third-to-last tank and/or to a tank situated further to the front.

Finally, the process according to the invention is distinguished by the fact that the division ratio is controlled through the adjustment of the main component stream and the timing ratio of the dosing unit in the middle and/or penultimate tank—defined as the operating time of the dosing unit to the pause time of the dosing unit—and/or the frequency of response of the other freshwater inlet is/are used as adjustable variables. In this way, the division ratio can be automatically established and controlled and the process can be carried out with a uniform concentration.

The invention is described in more detail in the following with reference to the accompanying drawings, wherein:

DETAILED DESCRIPTION OF THE INVENTION

Figure 1:
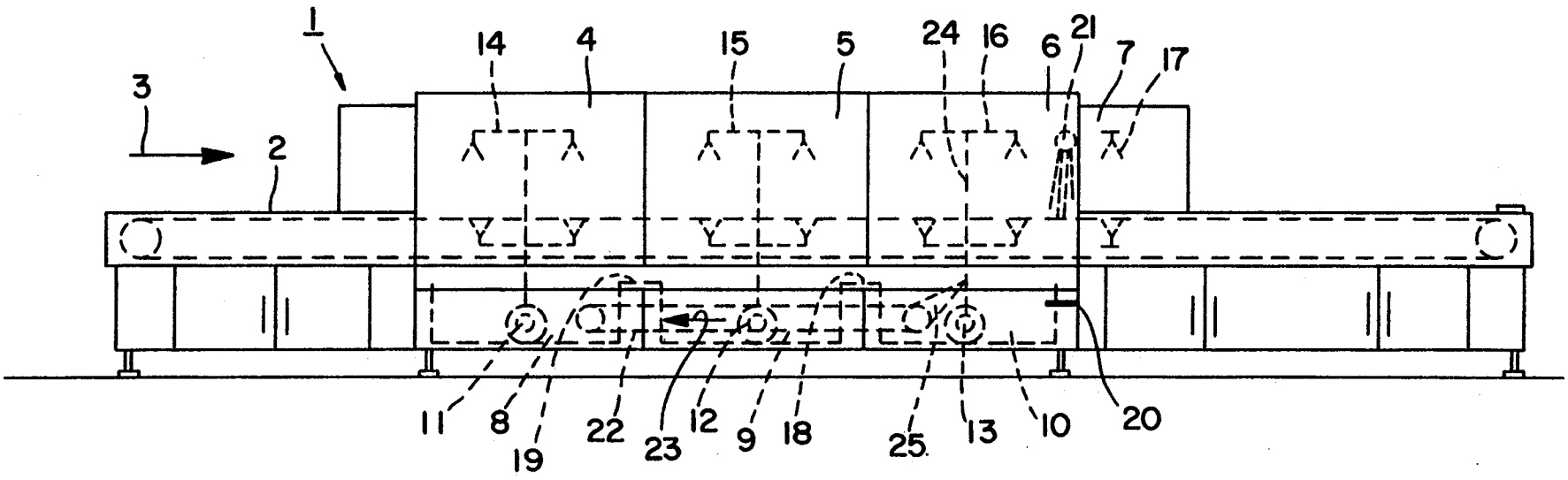
FIG. 1 shows a machine for carrying out the process.

FIG. 1 schematically illustrates an institutional dishwashing machine globally denoted by the reference 1. The soiled dishes are loaded into the dishwashing machine at the entrance 2 and pass through the dishwashing machine 1 in the direction of the arrow 3. The dishwashing machine comprises wash zones 4, 5 and 6 of which the wash zone 4 is also known as the pump clearing zone. The wash zone 6 is followed by the rinse or final rinse zone 7. Associated with each of the wash zones 4, 5 and 6 is a tank 8, 9 or 10 from which the wash liquor present in the particular tank is fed to spray nozzles 14, 15 and 16 by means of circulation pumps 11, 12, 13. Since the dishes pass through the machine 1 in the arrowed direction, the tank 8 is also referred to as the first or third-to-last tank, the tank 9 as the middle or penultimate tank and the tank 10 as the final tank both in the following and elsewhere in the present specification. By means of the spray nozzles 14, 15 and 16, the wash liquor is sprayed onto the dishes from above and below as they pass through the dishwashing machine 1. In the rinse or final rinse zone 7, the dishes are sprayed with fresh water from a spray nozzle 17. The quantity of fresh water sprayed here represents the quantity of fresh water flowing into the dishwashing machine 1 and passes into the tank 10. From the tank 10, there is a cascade-like overflow 18 to the tank 9 and, from there, a cascade-like overflow 19 to the tank 8. Each of the tanks 8, 9 and 10 preferably comprises a connection (not shown) for the introduction of detergent, the tanks 9 and 10 additionally comprising a conductivity measuring system which has not been shown either. However, the parts which have not been shown are already known from conventional dishwashing machines. Finally, the last tank 10 comprises a level electrode or probe 20. In addition, another fresh water inlet 21 with fan jet nozzles is provided in the last wash zone 6. However, this freshwater inlet may also be arranged in the rinse zone 7.

Now, the crucial aspect of the dishwashing machine 1 so far as the process according to the invention is concerned is that a bypass pipe 22 is provided to enable the wash liquor to flow through from the last tank 10 to the first tank 8 in the direction of the arrow 23, bypassing the penultimate or middle tank 9. A pump or flow restrictors or similar devices may be provided in the bypass 22 to enable the quantity of wash liquor flowing through the bypass to be adjusted and controlled. However, there is preferably no pump or flow restrictor in the bypass 22 and, instead, the entrance of the bypass 22 is connected as shown to a branch from the riser 24 on the pressure side of the circulation pump 13 of the last tank 10 by means of a pipe or hose connection 25. To regulate the main component stream to be fed to the bypass 22, a suitable adjustable flow-restricting element, for example in the form of an optionally automatically adjustable diaphragm or slide, is arranged at the opening of the hose or tube 25 into the riser 24.

Basically, the process to be carried out in the above-described dishwashing machine takes place in substantially the same way as in conventional dishwashing machines. The dishes pass through the dishwashing machine 1 from front to back in the direction of the arrow 3 while the water, which is mainly introduced in to the rinse zone 7 through the spray nozzle 17, passes through the machine in the opposite direction. The entire quantity of fresh water flowing in passes first into the last tank 10 where it is divided into a main component stream and a secondary component stream. The secondary component stream cascades through the individual tanks of the dishwashing machine 1 via the overflows 18 and 19 whereas the main component stream branches off in the last wash zone 6 or rather the last tank 10 and is fed to the first tank 8, bypassing the middle tank 9. The middle tank 9 can thus be operated at a higher concentration than usual without any increase in detergent consumption by comparison with normal operation because detergent need only be after-dosed in accordance with the volume of the inflowing secondary component stream. In the process according to the invention, the after-dosing of detergent occurs only in the middle tank 9 whereas the concentration in the other tanks is established by the carryover of wash liquor from the tank 9 or rather the wash zone 5 into the wash zone 6 and through the bypass 22 or the cascade-like overflow 19 in the wash zone 4.

By means of the conductivity measurements (not shown) in the middle tank and the last tank and the associated dosing units, it is possible to adjust and maintain the desired concentrations of detergent in the individual tanks. Since the middle tank 9 is intended to operate with an increased concentration of detergent, the additional spray nozzle 21 for introducing fresh water is provided in the last wash zone 6 so that, in the event of an increase in concentration detected through the conductivity measurement (not shown), the concentration can be reduced by the introduction of fresh water. The additional freshwater spray nozzle 21 is also used to introduce fresh water when the level probe 10 indicates a reduced liquid level. This can happen when, through a control error, more water or liquid is removed from the tank 10 through the bypass 22 than is introduced through the freshwater inlet 17.

With the aid of a mathematical example, it is intended in the following to show that detergent can be saved through the diversion of the main component stream. For this purpose, it is assumed that the tank 8 has a holding capacity of 100 liters, the tank 9 a holding capacity of 150 liters and the tank 10 a holding capacity of 150 liters. In addition, the throughput of final rise water (fresh water) through the spray nozzle 17 is assumed to be 400 liters per hour. Whereas a concentration of 3 g detergent/l wash liquor is adjusted in a conventional process, a concentration of 2 g detergent/l wash liquor is established in tanks 8 and 10 while a concentration increased to 6 g detergent/l wash liquor is established in the middle tank 9 in the process according to the invention.

Before the beginning of the actual wash cycle, the tanks are first filled by so-called predosing. To this end, fresh water flows in through the spray nozzle 17 while detergent is introduced into the tank 10. The desired concentration is controlled via the conductivity measurement (not shown). The bypass 22 is closed so that all the water introduced cascades from the tank 10 into the tank 9 and then into the tank 8 which is provided with an outlet (not shown). With the usual dosage of 3 g/l and the assumed tank capacities, the consumption of detergent in the predosing phase is 1200 g.

Predosing takes place in the same way in the process according to the invention except that a concentration of only 2 g/l is initially established. After the three tanks have been filled with this concentration, the additional freshwater inlet is first closed. The circulation pump 12 in the middle tank 9 is switched on and detergent is introduced until a concentration of 6 g/l, as determined by conductivity measurement, has been established in this tank. Accordingly, the consumption of detergent in the predosing phase is 1400 g. The actual dishwashing process, in which fresh water is to be introduced at a rate of 400 liters per hour, then takes place. In the process according to the invention, the liquid streams are to be divided up, for example, in such a way that 300 liters per hour pass through the machine via the bypass 22 and 100 liters per hour via the cascade route. For the after-dosing of detergent during the dishwashing process, this means that, in the conventional process, detergent has to be introduced at a rate of 1200 g per hour to establish a concentration of 3 g/l. In the process according to the invention, only 400 to 600 g detergent/hour need be introduced to bring the secondary component stream flowing into the middle tank at 100 l/hour to the desired increased detergent concentration of 6 g/l. The carryover of wash liquor by the dishes from the penultimate or middle tank into the last tank, where the wash liquor is rinsed off the dishes by the spray nozzle 16, is sufficient to adjust the remaining quantity of fresh water flowing in at 300 l/h (difference between 400 l/h and 100 l/h) to the desired detergent concentration of 2 g/l.

Accordingly, the consumption of detergent in the conventional dishwashing process for an operating time of, for example, 3 hours per day is 1200 g for the predosing phase and 3600 g (3 times 1200 g) for the after-dosing phase, which gives a total consumption of 4800 g. By contrast, the consumption of detergent in the process according to the invention is 1400 g in the predosing phase and 1800 g (3 times 600 g) in the after-dosing phase, which gives a total consumption of 3200 g. Accordingly, the theoretical saving of detergent amounts to 1600 g detergent/day. Now, this saving opens up the possibility of either using less detergent or of further increasing the concentration in the middle tank until the increase corresponds exactly to the quantity of detergent saved, i.e. to the factor of the division ratio of final rinse water to the secondary component stream, or of using the quantity saved for so-called thorough washing in a subsequent single dishwashing cycle.

Accordingly, the process according to the invention may be summarized as follows:

After predosing, detergent is only after-dosed into one tank where an increased concentration is established. Only a secondary component stream rather than the entire volume of wash liquor corresponding to the inflowing volume of fresh water is introduced into this tank. The main component stream is guided around this tank by means of a bypass.

So far as the control of the process according to the invention is concerned, it is particularly appropriate if the main component stream is branched off on the pressure side of the circulation pump 13 from the riser 24 of the last tank 10. The main component stream is regulated by suitable flow restricting elements, such as diaphragms, slides, valves, etc., in such a way that the sum total of the main component stream and secondary component stream substantially corresponding to the inflowing volume of fresh water (final rinse water). In the example cited above, 300 l/h main component stream plus 100 l/h secondary component stream=400 l/h fresh water. In addition, the main component stream is regulated in such a way that the desired division ratio $f_T$ of the volume of final rinse water to the secondary component stream is obtained. In the example, 400 l/h: 100 l/h=4. Since the after-dosing of detergent only occurs in the tank where an increased concentration prevails, so that only the volume of secondary component stream flowing into this tank has to be after-dosed, the division ratios $f_T$ indicates the factor by which the concentration of detergent in this dosing tank can be increased without any increase in the consumption of detergent over the conventional dishwashing process on which the comparison is based.

The described division ratio may also be automatically controlled if a controllable and adjustable slide or the like is arranged as a flow restricting element in the vicinity of the branch of the main component stream. The adjustable variable used may be, for example, the timing ratio Tv which is defined as the operating time of the dosing unit to the pause time of the dosing unit. If the timing ratio Tv increases, which is equivalent to an increase in the secondary component stream, the flow restricting element in the main component stream is slightly opened. This automatic control system should operate with a large time constant to avoid over-reactions. The frequency of response of the level-controlled additional freshwater inlet 21 could also be used as another indicator of an excessive main component stream. The response frequency of the freshwater inlet 21 could be determined and supportively used as another controlled variable in the automatic control system governed by the timing ratio Tv.

The process according to the invention may also be used only occasionally and a conventional dishwashing process otherwise applied. This would mean that the flow restricting element regulating the main component stream would only be opened occasionally, i.e. for the particular wash cycles required, and the total quantity of inflowing fresh water would cascade through the dishwashing machine. However, this would mean that the detergent would actually have to be dosed in the last tank 10.

Figure 2:
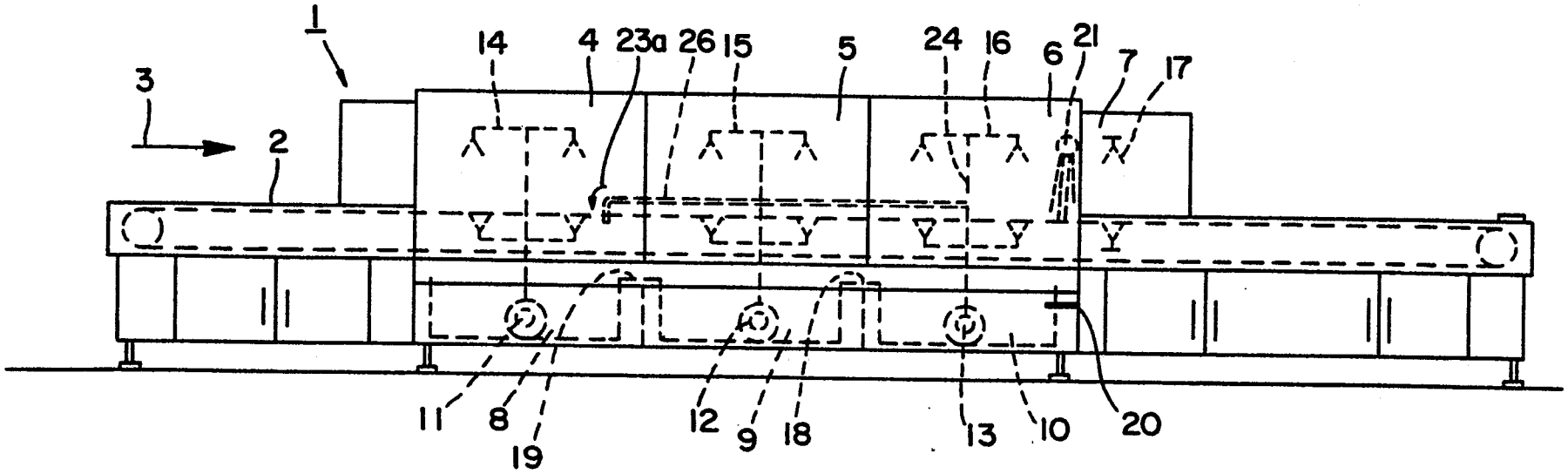
FIG. 2 shows an alternative embodiment of the machine.

FIG. 2 shows an alternative embodiment of a dishwashing machine for carrying out the process according to the invention in which the bypass 22 is differently arranged. In FIG. 2, the same parts or zones as in FIG. 1 have been denoted by the same reference numerals. In contrast to the machine shown in FIG. 1, the bypass 26 in the machine shown in FIG. 2 is arranged above the tanks 8, 9, 10. The bypass 26 leads in the form of a tube or hose connection from the riser 24 on the pressure side of the circulation pump 13 of the last tank 10 above the wash liquor level in the various tanks 8, 9, 10 to the tank 8 into which it opens. The main component stream guided through the bypass 26 emerges there in the direction of the arrow 23*a*. In this embodiment, too, the division ratio between the main component stream and the secondary component stream is controlled by means of a flow restricting element which is suitably arranged in the bypass 26 and which may optionally be automatically controlled. The advantage of this embodiment is that the required division ratio to be established between the main component stream and the secondary component stream is independent of the particular level in the tanks 10 and 8. In addition, the desired division ratio may readily be monitored and, optionally, recorded by a device for measuring throughflow arranged in the bypass 26.

Figure 3:
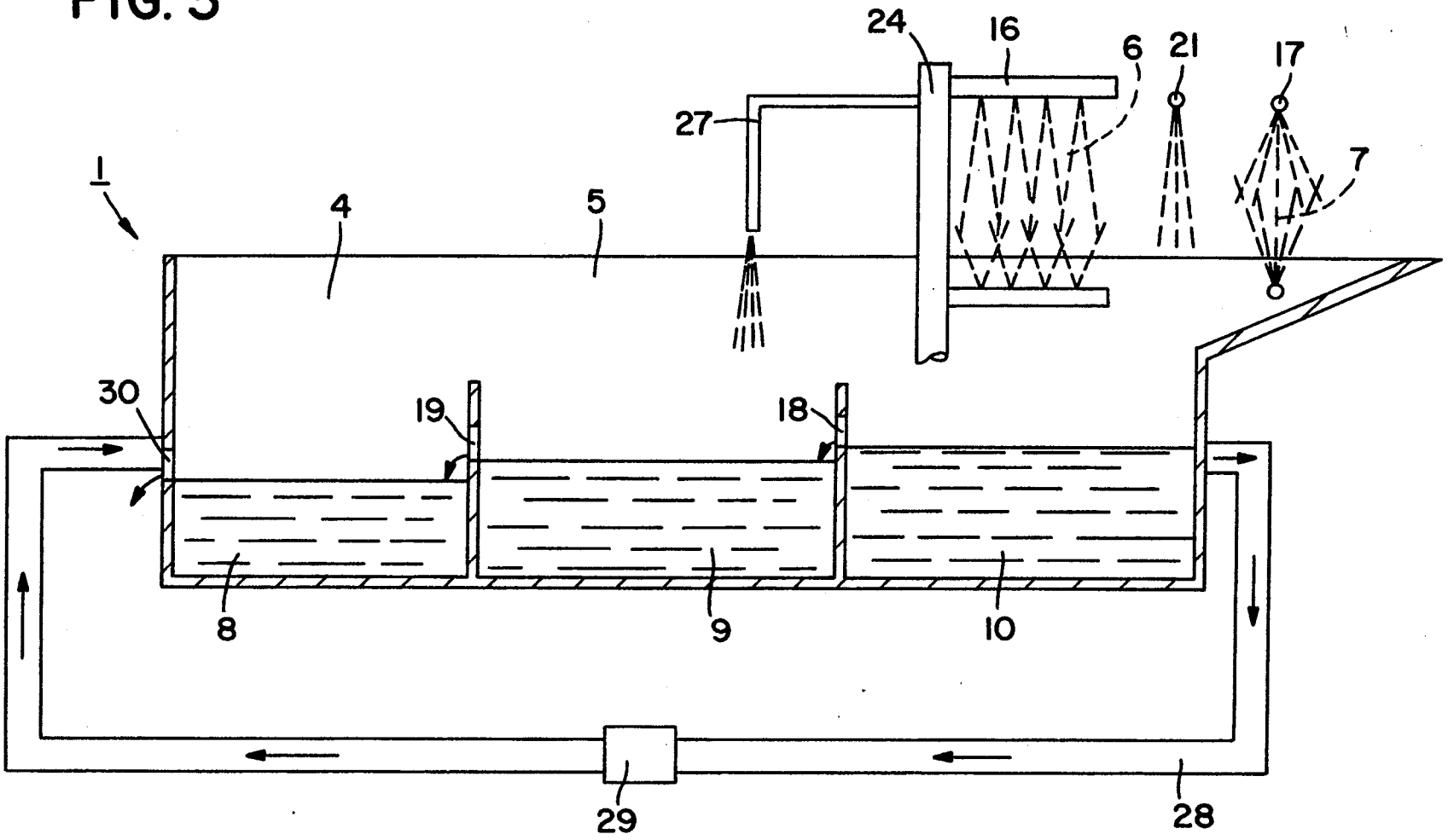
FIG. 3 shows another embodiment of a machine for carrying out the process.

Another embodiment is schematically illustrated in FIG. 3 where the same parts as in FIGS. 1 and 2 have again been denoted by the same reference numerals. FIG. 3 does not show the necessary elements, such as spray nozzles, etc., which are shown in FIGS. 1 and 2. The difference from the embodiments shown in FIGS. 1 and 2 lies solely in the design of the parts 27 to 29.

In the embodiment shown in FIG. 3, a pipe 27 branches off from the riser 24 on the pressure side of the circulation pump 13 and opens into the tank 9 above the liquid level. By means of the pipe 27, the desired component stream is branched off from the riser 24 and fed to the penultimate tank 9. The main component stream is fed from the last tank 10 to the third-to-last and/or first tank 8 by means of a bypass 28. In addition cascade-like overflows 18 and 19 are formed between the individual tanks. In this case, however, the point at which the by pass 28 opens into the tank 10 is situated at a lower level than the overflow 18 so that all the inflowing, non-circulated water first flows off into the bypass 28, the overflow 18 basically only preventing the wash liquor from overflowing from the tank 10. The point at which the bypass 28 opens into the tank 8 is situated at a lower level than the point at which it opens into the tank 10 although the opening of the bypass 28 into the tank 8 is situated above the outflow opening 30 formed therein. Also arranged in the bypass 28 is a magnetic valve 29 which is closed during filling of the tanks 8 to 10 on the overflow principle and during predosing and which is opened when the dishwashing machine is brought into operation.

We claim:

1. A process for the continuous washing of soiled crockery in a dishwashing machine comprising: passing the soiled crockery successively from a first wash zone to a last wash zone, each wash zone comprising a wash tank, wherein the crockery is sprayed with wash liquor in at least three wash zones fed from the wash tanks by means of circulating pumps and a system of spray nozzles, the wash liquor passing from the last wash tank to the first wash tank to provide washed crockery passing from the last wash zone; passing the washed crockery to a rinse zone to rinse the washed crockery; predosing a detergent to establish a detergent concentration in the wash liquor in the individual wash tanks; after-dosing detergent into penultimate wash tank to provide fresh detergent, after the start of the washing process; introducing fresh water into the last wash tank; passing a first wash liquor stream, comprising at least 50% of the quantity of the fresh water introduced into the last wash tank, directly from the last wash tank to a wash tank which is in front of a penultimate wash tank, in a direction of passage of crockery to the penultimate wash tank, and a remaining quantity of wash liquor passes through the wash tanks in succession as a second stream; and introducing the after-dosed detergent into the penultimate wash tank, to increase the detergent concentration in the penultimate wash tank by at most the factor of a division ratio of the amount of fresh water to the amount of the second stream whereby the crockery is contacted with a wash liquor having an increased detergent concentration.

2. A process as claimed in claim 1, wherein the detergent concentration, established in the wash tanks by predosing, is below an operating concentration and a quantity of detergent, not added by predosing, is added to the penultimate wash tank by afterdosing in a wash cycle to provide an increased concentration of detergent.

3. A process of claim 2 wherein the division ratio is a value between 1 and 20.

4. A process of claim 2 wherein the fresh water flowing into the last wash tank flows from the rinse zone.

5. A process of claim 1, wherein the division ratio is adjusted to a value between 1 and 20.

6. A process of claim 1, wherein the quantity of fresh water flowing into the last wash tank flows from the rinse zone.

7. A process of claim 1, wherein fresh water is fed to the last wash tank via a freshwater inlet in response to a signal from a level probe.

8. A process of claim 1, wherein conductivity of the wash liquor in the last wash tank is monitored to determine if the detergent concentration in the wash liquor is in an operating range and, if the operating range is exceeded, additional freshwater is introduced into the last wash tank.

9. A process of claim 1, wherein the first wash liquor stream is branched from a conduit on a pressure side of the circulation pump of the last wash tank and the second stream cascades through the wash tanks in series from the last wash tank to the first wash tank.

10. A process of claim 1, wherein the second stream is branched from a conduit on a pressure side of the circulation pump of the last wash tank and is fed to the penultimate wash tank while the first wash liquor stream is guided by means of a bypass from the last wash tank to a wash tank in front of the penultimate wash tank in the direction of passage of the crockery to the penultimate wash tank.

11. A process of claim 1, wherein the division ratio is controlled by at least one means selected from the group consisting of adjustment of the first stream by a timing ratio of a dosing unit in a flow channel for the first stream wherein the timing ratio is defined as the on time of the dosing unit to the off time of the dosing unit and a response frequency of a freshwater inlet.

12. A process of claim 1 wherein the first stream comprises at least 75% of the quantity of fresh water flowing into the last wash tank.

13. A process of claim 12 wherein the division ratio is from 3 to 10.

14. A process of claim 1 wherein the second stream passes successively from the last tank to the first tank by overflow successively from tank to tank.

15. A process of claim 1 wherein the first wash liquor stream flows directly from the last wash tank to a wash tank in front of the penultimate wash tank by overflow from a level of wash liquor in the last wash tank at a higher level than the wash liquor in the wash tank in front of the penultimate wash tank.

16. A process of claim 1 wherein the concentration of detergent in the penultimate wash tank is maintained at about 6 grams/liter.

* * * * *